US007975968B2

(12) United States Patent
Bohlmann et al.

(10) Patent No.: US 7,975,968 B2
(45) Date of Patent: Jul. 12, 2011

(54) METHOD AND APPARATUS FOR DETECTION OF THE OCCUPIED OR FREE STATE OF A TRACK SECTION

(75) Inventors: Peer Bohlmann, Schönwalde (DE); Bernd Raschke, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 55 days.

(21) Appl. No.: 12/301,564

(22) PCT Filed: May 11, 2007

(86) PCT No.: PCT/EP2007/054602

§ 371 (c)(1),
(2), (4) Date: Nov. 19, 2008

(87) PCT Pub. No.: WO2007/134995

PCT Pub. Date: Nov. 29, 2007

(65) Prior Publication Data

US 2009/0194643 A1 Aug. 6, 2009

(30) Foreign Application Priority Data

May 19, 2006 (DE) ..... 10 2006 024 692

(51) Int. Cl.
*B61L 23/34* (2006.01)

(52) U.S. Cl. ..... 246/122 R; 701/19

(58) Field of Classification Search ..... 246/122 R, 246/254, 255, 28 R, 34 R, 35, 36, 34 A, 34 B, 246/98

See application file for complete search history.

(56) References Cited

U.S. PATENT DOCUMENTS

| | | | | |
|---|---|---|---|---|
| 3,307,032 | A * | 2/1967 | Delugeau | 246/34 R |
| 3,359,416 | A * | 12/1967 | Wilcox | 246/34 CT |
| 6,729,584 | B2 * | 5/2004 | Ireland | 246/122 A |
| 7,254,467 | B2 * | 8/2007 | Fries et al. | 701/19 |
| 7,523,893 | B2 * | 4/2009 | Francis et al. | 246/34 A |
| 2004/0181321 | A1 * | 9/2004 | Fries et al. | 701/19 |
| 2005/0075765 | A1 * | 4/2005 | Oguma et al. | 701/19 |
| 2005/0137760 | A1 * | 6/2005 | Watanabe et al. | 701/19 |

(Continued)

FOREIGN PATENT DOCUMENTS

WO WO 2004071839 A1 * 8/2004

(Continued)

*Primary Examiner* — S. Joseph Morano
*Assistant Examiner* — Jason C Smith
(74) *Attorney, Agent, or Firm* — Laurence A. Greenberg; Werner H. Stemer; Ralph E. Locher

(57) ABSTRACT

A method and a device for detecting the occupied or free status of a section of track by way of a track current circuit, into which a transmitted signal is introduced and from which at least one detection signal is extracted. A longer maximum possible track length is achieved in that the track current circuit is divided into part sections overlapping over half the length thereof. The transmitted signal is introduced in the middle of each part section into which a rail vehicle enters, detection signals being extracted at both ends of the part section or further transmitted over adjacent part sections to the track circuit ends and extracted there. Each part section is provided in the center and the ends thereof with transceiver devices. The central transceiver device functions as a transmitter and the end transceiver devices function as receivers.

5 Claims, 4 Drawing Sheets

U.S. PATENT DOCUMENTS

2005/0205719 A1* 9/2005 Hendrickson et al. .... 246/122 R
2005/0279891 A1* 12/2005 Ebuchi et al. ..... 246/122 R
2006/0060724 A1* 3/2006 Francis et al. ..... 246/122 R
2007/0276555 A1* 11/2007 Kiss et al. ..... 701/19
2008/0142645 A1* 6/2008 Tomlinson et al. ..... 246/122 R
2009/0194643 A1* 8/2009 Bohlmann et al. ..... 246/122 R
2009/0277998 A1* 11/2009 Kiss et al. ..... 246/122 R

FOREIGN PATENT DOCUMENTS

WO WO 2004098975 A2 * 11/2004

* cited by examiner

METHOD AND APPARATUS FOR DETECTION OF THE OCCUPIED OR FREE STATE OF A TRACK SECTION

BACKGROUND OF THE INVENTION

Field of the Invention

The invention relates to a method and an apparatus for detection of an occupied or free state of a track section by means of a track circuit into which a transmission signal is fed, and out of which at least one detection signal is output.

The fundamental principle of detection of the occupied or free state of the track section is that a transmitter generates a transmission signal which is transmitted via a track circuit, which represents the track section to a receiver, with the receiver interpreting the transmission signal. With a center feed, the transmitter is provided approximately at the center of the track section, and receivers are provided at both the ends of the track section. Depending on the length of the track section to be monitored, a transmission signal is set at the transmitter such that the receiver can identify the transmission signal produced by the transmitter. The bedding resistance of the track has a considerable influence on the setting parameters and on the maximum length of the track section. This bedding resistance can change over a very wide range, for example by a factor of 100, during operation. Relatively large track areas, which go beyond the maximum lengths, are normally monitored by connecting a plurality of track circuits in series and by using other track monitoring devices, for example axle counters.

The presence of a rail vehicle in the track section becomes evident from the receiver not receiving any signal, or receiving a weak signal, from the transmitter for a defined time. A high transmission voltage and thus a high transmission current are therefore desirable to allow the receiver to identify well the transmission signals in the case of a free track section. However, an excessively high transmission signal could result in the receiver identifying correct transmission signals even when a rail vehicle is present in that track section, as a result of which the occupied state of the track section would not be detected. The maximum length of the track section in which reliable monitoring of the occupied state is possible is in consequence limited.

BRIEF SUMMARY OF THE INVENTION

The invention is based on the object of specifying a method and an apparatus for detection of the occupied or free state of a track section, which allows reliable monitoring even over relatively long track sections.

According to the method, the object is achieved in that, the track circuit is subdivided into subsections which overlap over half their length, and in that the transmission signal is fed centrally into that subsection which a rail vehicle is entering with detection signals being output at both ends of the subjection or being passed on via adjacent subsections to the track circuit ends, and being output there. An apparatus for carrying out the method is characterized in that the track circuit is composed of a plurality of subsections which overlap over half their length and, centrally and at the end, have transmitter/receiver devices for feeding in the transmission signal and for outputting the detection signal, or for passing on the detection signals to the track circuit ends and for outputting them there, with the central and one end transmitting/receiving device in each case being common to the overlapping subsections. This results in traveling activated subsections, in which case the effective area of the transmitter/receiver remains unchanged on the basis of applicable electrical characteristics of the track. Since the track circuit may be composed of any given number of overlapping subsections, the maximum length of the track section which can be monitored by a single track circuit can be multiplied in comparison to the known solution. In this case, the fundamental method of operation with regard to free and occupied signaling can remain unchanged. The detection signal to be evaluated can either be output directly from the subsections or can be passed on via the transmitter/receiver devices to the track circuit end, where it can be output. The evaluation of the detection signal, specifically detection of whether the track section is free or occupied, is normally carried out in a signal box. Only one evaluation of the output detection signals need be carried out for each track circuit. The increased length of the track circuit results in savings in terms of the number of evaluation devices required in the signal box, associated with a reduction in the space requirement, a reduction in the spares holdings of replacement components, and an increase in MTBF (mean time between failures). The configuration process is simplified and the total number of track circuits per project is reduced. The installation and test effort is decreased. Finally, the track sections can be better matched to signal intervals and block lengths, thus resulting in maintenance and cost advantages.

The detection signals are used as a switching criterion for successive activation of the subsections. For this purpose the detection signal is supplied to a control device which is preferably located in the signal box. The control device is used to pass on the transmitter/receiver devices, which act as transmitters, in a defined sequence to points in a row along the track. In this case, the free and occupied information from the two transmitter/receiver devices which act as receivers for the respective subsection forms the necessary switching criteria. At the moment when a rail vehicle has moved over the transmitter/receiver device which is acting as a transmitter, the two receivers of the transmitter/receiver devices no longer produce occupied signals, as a result of which the control device produces a drive signal, which switches the transmitter that is currently being moved over to the receive mode, switches the next transmitter/receiver direction in the direction of travel to the transmission mode, and switches the next-but-one device to the receiver mode. The next subsection is thus activated. The exit from the lengthened track circuit takes place in the same way as for the known center feeding of short track circuits.

Once the last axle of the rail vehicle has exited the lengthened track circuit, the free state is detected by monitoring the detection signal at least one end of the track circuit. In the case of tracks which are traveled over in only one direction, permanent monitoring of the entry end of the track circuit is sufficient, whereas, in the case of tracks which are traveled over in both directions, monitoring is required at both ends of the track circuit.

In order to ensure that the track circuit is operating correctly, all the subsections are preferably regularly successively activated in the free state. This functional test can be carried out, for example, once per hour.

The invention will be described in more detail in the following text with reference to illustrations in the figures, in which:

DESCRIPTION OF THE INVENTION

Figure 1:
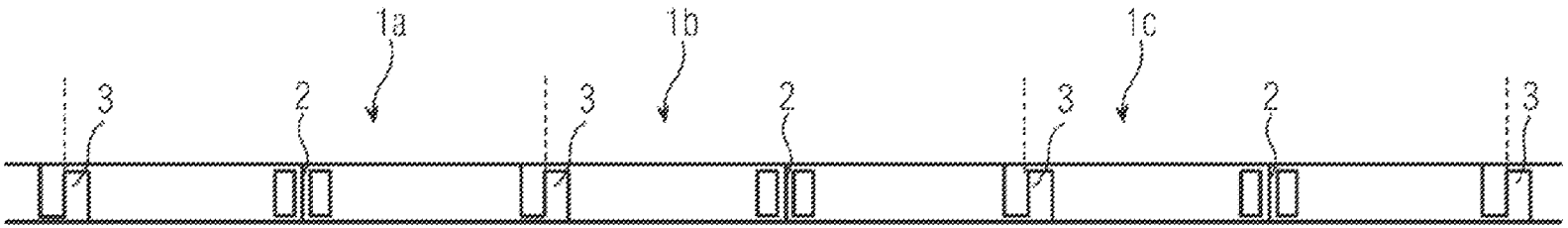
FIG. 1 shows an outline illustration of track circuits of a known type arranged in a row.
Figure 2:
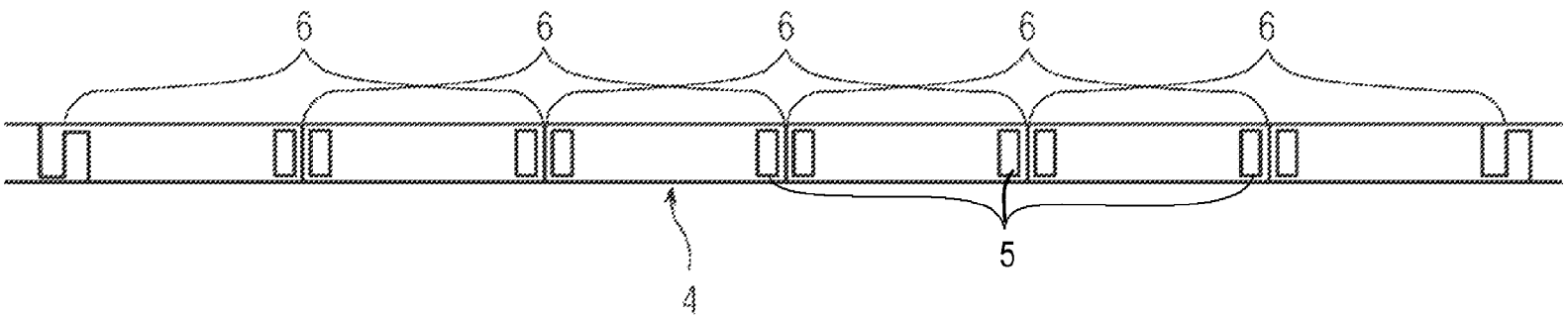
FIG. 2 shows track circuits of the claimed type illustrated in the same way as in FIG. 1.

Track circuits 1*a*, 1*b*, 1*c* are normally arranged directly in a row with one another for uninterrupted monitoring of a track area. By way of example, FIG. 1 shows three track circuits 1*a*, 1*b*, 1*c* which each comprise a centrally arranged transmitter 2 and two receivers 3 at the ends.

In comparison to this known type, lengthening of the track circuit 4 is envisaged by connecting transmitter/receiver devices 5 in between. In consequence, the track circuit 4 is subdivided into subsections 6 which overlap over half their length. The subsections 6 are in this case of essentially the same length.

Figure 3A:
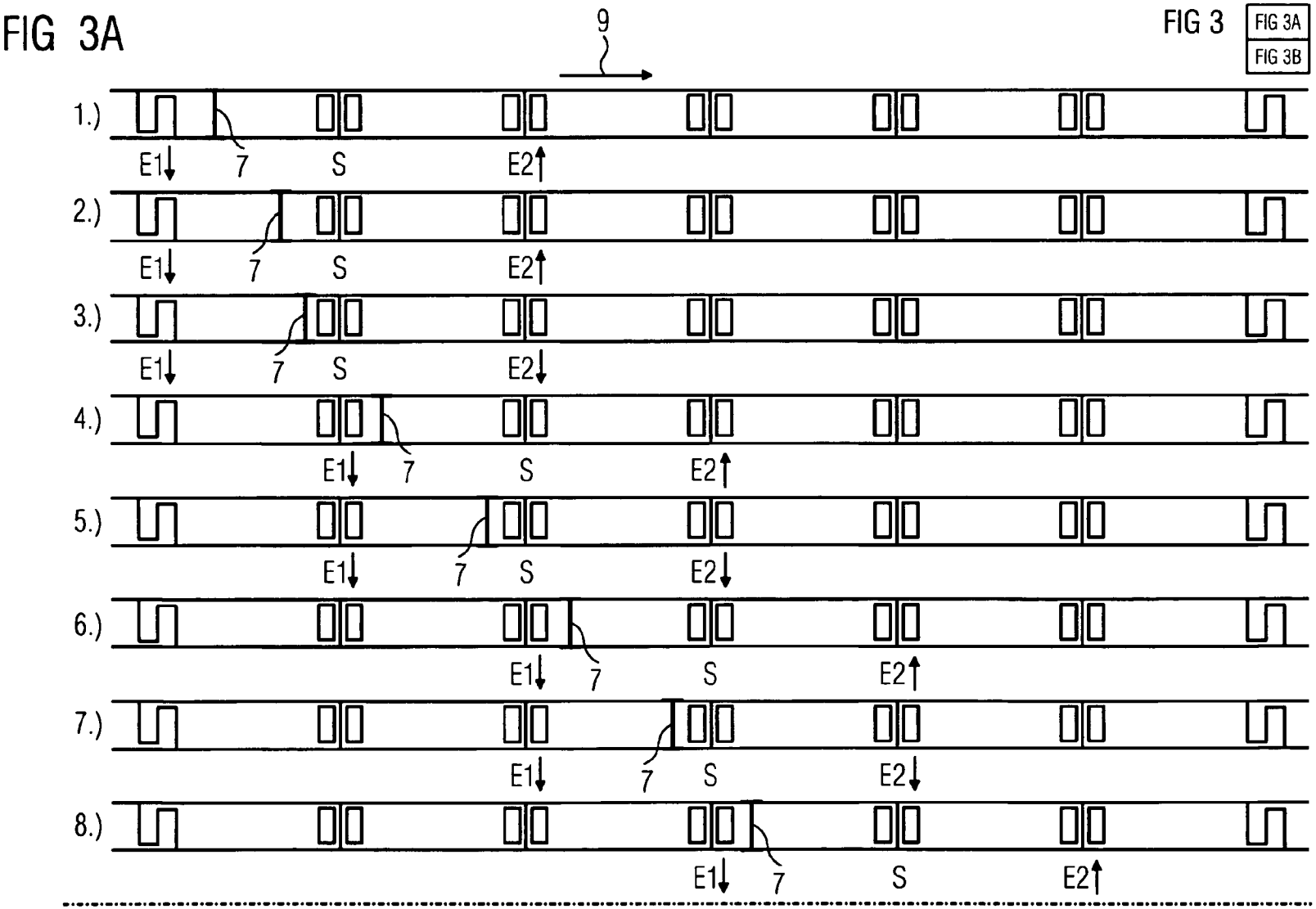
FIG. 3 shows a process of a train traveling through, FIG. 4 shows a process of checking the serviceability of the track circuit.
Figure 3B:
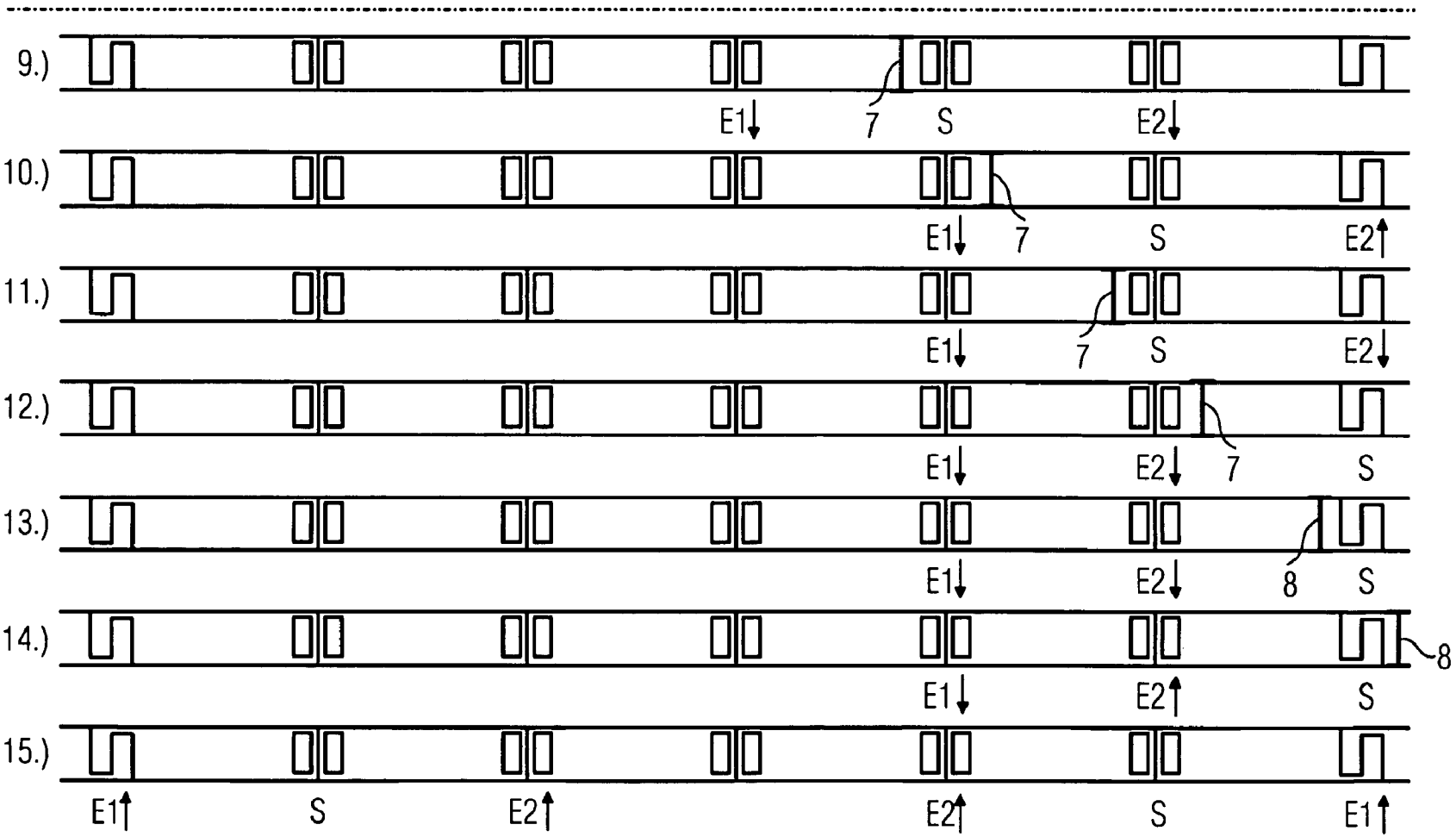

FIG. 3 shows the process of a train traveling through from the entry of a first axle 7 into the track circuit 4 to the exit of a last axle 8 from the track circuit 4 in the direction of travel indicated by an arrow 9. The individual movement locations of the first axle 7 are illustrated in the process schematics 1.) to 12.), while the process schematics 13.) and 14.) show the last axle 8, and the process schematic 15.) shows the free state.

As can be seen from 1.), the first axle 7 on the rail vehicle has entered the track circuit 4. This entry is detected by the first subsection 6 being active. To do this, a control device in the signal box switches the first transmitter/receiver device 5 of the track circuit 4 to be the receiver E1, the second transmitter/receiver device 5 to the transmitter S, and the third transmitter/receiver device to be the second receiver E2. The first receiver E1 signals at 1.) and 2.) the occupied state of the track circuit 4 to the signal box. The first axle 7 is not yet in the active area of the transmitter S—second receiver E2, as a result of which the second receiver E2 produces a detection signal which characterizes the free state.

A detection signal which is signaling a free state is illustrated symbolically by an arrow pointing upwards, and a detection signal which signals an occupied state is illustrated symbolically by an arrow pointing downwards, with these detection signals being respectively associated with the receivers E1 and E2.

At 3.), the first axle 7 is sufficiently close to the transmitter S that both receivers E1 and E2 are located in the affected area, and both receivers E1 and E2 therefore signal an occupied state. This double occupancy signal is the switching criterion for passing on the subsections 6. A control device which is not illustrated but is normally located in a signal box switches on the transmitter/receiver devices 5 such that the transmitter S according to 3.) becomes the receiver E1 according to 4.), and the second receiver E2 according to 3.) becomes the transmitter S according to 4.). Furthermore, the transmitter/receiver device 5 which follows the new transmitter S is switched to be the new receiver E2. At 4.), E1 produces an occupied signal, and E2 a free signal. In the fifth position of the first axle 7, this axle 7 is—as in the third position—within reception range of both receivers E1 and E2, so that they signal a busy state, and the criteria for switching on is satisfied. Analogous switching on takes place at the positions 3.), 5.), 7.) and 9.), while, at the intermediate positions 2.), 4.) 6.), 8.) and 10.), the transmitter/receiver device 5 which is in each case acting as the first receiver E1 produces a detection signal which signals the occupied state as a result of which the entire track circuit is regarded as being occupied. In this case, the outputting of the detection signals E1 and E2 can be carried out directly or, by passing on via the adjacent transmitter/receiver devices 5 to the track circuit ends, only at these first and last transmitter/receiver devices of the track circuit 4. In the latter variant, the wiring can be simplified.

At the positions 12.), 13.) and 14.), the successive passed-on subsection 6 remains in existence, since this subsection 6 is the last in the track circuit 4. The detection signal of the track circuit 4 is kept in the occupied state until the last axle 8 has traveled over the last transmitter/receiver device 5. This is detected by this last transmitter/receiver device 5 being switched to be a transmitter S at the positions 12.) to 14.) as a result of which the penultimate transmitter/receiver device 5 acts as a second receiver E2. This receiver E2 signals the free state after the last axle 8 has exited the track circuit 4, thus generating a switching-back criterion which is used by the control device in order to switch the track circuit 4 back to the basic position, which is illustrated at 15.).

In this basic position, which corresponds to the free state of the track circuit 4, both ends of the track circuit 4 are monitored for being free or occupied, in the exemplary embodiment shown in FIG. 3. It is assumed that the illustrated track section can be traveled over in both directions of travel, as a result of which either both track circuit ends must be monitored at the same time or only the respective entry end of the track circuit 4, as illustrated in FIG. 5, depending on the next train that is expected to travel through.

Figure 4:
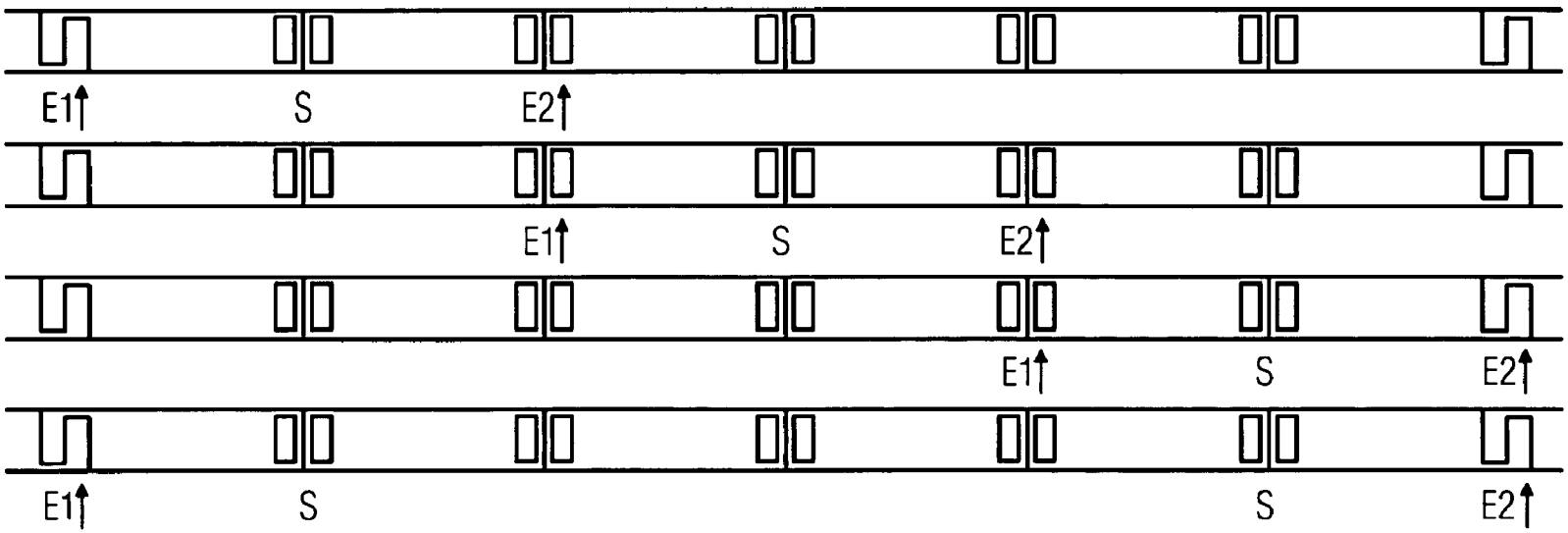

FIG. 4 shows a process for continuity testing of all the components of the track circuit 4 in the free state, illustrated in the same manner as FIG. 3. In this case, the free signaling state of the two receivers E1 and E2 is used as the criteria for passing on, rather than the occupied state signal. This test is preferably provided at regular intervals, for example once per hour.

Figure 5:
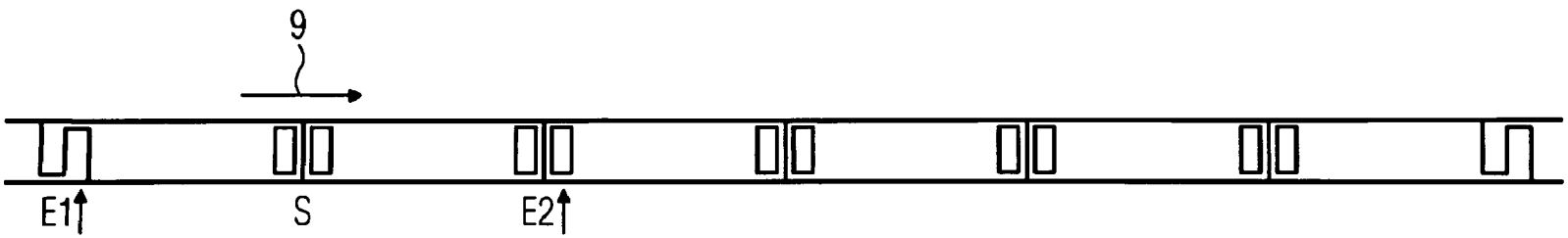
FIG. 5 shows the monitoring of the free state.

FIG. 5 illustrates the monitoring of the free state of the track circuit 4, which is carried out permanently until the next train passes through. In the exemplary embodiment shown in FIG. 5, only one end of the track circuit 4 is monitored, which is sufficient if the track section can be passed over in only one direction of travel or if it is known that the next train will travel through in the direction of travel indicated by the arrow 9.

The invention claimed is:

1. A method for detecting an occupation state of a track section, the method which comprises:

dividing a track circuit into subsections, wherein each of the subsections of the track circuit has a length, half of the length of each of the subsections of the track circuit overlaps half of the length of an adjacent one of the subjections of the track circuit, and each of the subsections of the track circuit has two ends and a center;

providing one end of each one of the subsections with a transmitter/receiver device including a transmitter and a receiver, providing another end of each one of the subsections with a transmitter/receiver device including a transmitter and a receiver, and providing a single center location of each one of the subsections with a transmitter/receiver device including a transmitter and a receiver;

feeding a transmission signal into the track circuit at the center into a subsection in which a rail vehicle is entering; and outputting detection signals from the two ends of the respective subsection of the track circuit or passing the detection signals to the ends of the track circuit and outputting the detection signals there;

deducing from the detection signals whether the track section is occupied or unoccupied; and using the detection signals as a switching criterion for successive activation of the subsections.

2. The method according to claim 1, which comprises detecting the free state by monitoring the detection signal at least one end of the track circuit.

3. The method according to claim 1, which comprises checking for a serviceability of the track circuit in the free state by successive activation of all the subsections.

4. An apparatus for detecting an occupation state of a track section of a rail vehicle-supporting track by carrying out the method according to claim 1, which comprises:

a track circuit composed of a plurality of subsections, each of said subsections of said track circuit having a length, half of the length of each of said subsections of said track circuit overlapping half of the length of an adjacent one of said subjections of said track circuit, each of said subsections of said track circuit having two ends and a center;

transmitter/receiver devices disposed at said center and at the end of a respective said subsection and configured for feeding in a transmission signal and for outputting a detection signal, or for passing on the detection signals to track circuit ends and for outputting them at the track circuit ends, wherein said transmitter/receiver devices respectively disposed at said center and at one end are in each case common to respectively overlapping subsections, wherein each one of said transmitter/receiver devices includes a transmitter and a receiver.

5. The apparatus according to claim 4, which further comprises a control device configured to receive the detection signal for activation of said transmitter/receiver devices.

* * * * *